US010429089B2

(12) United States Patent
Jeon

(10) Patent No.: US 10,429,089 B2
(45) Date of Patent: Oct. 1, 2019

(54) OUTDOOR UNIT FOR AIR CONDITIONER

(71) Applicant: LG ELECTRONICS INC., Seoul (KR)

(72) Inventor: Boohwan Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 431 days.

(21) Appl. No.: 14/596,404

(22) Filed: Jan. 14, 2015

(65) Prior Publication Data

US 2015/0198339 A1 Jul. 16, 2015

(30) Foreign Application Priority Data

Jan. 14, 2014 (KR) ..... 10-2014-0004314

(51) Int. Cl.

| | |
|---|---|
| ***F24F 1/24*** | (2011.01) |
| ***F25D 17/06*** | (2006.01) |
| ***F24F 1/48*** | (2011.01) |
| ***F24F 1/06*** | (2011.01) |
| ***F24F 1/46*** | (2011.01) |

(52) U.S. Cl.
CPC ..... *F24F 1/24* (2013.01); *F24F 1/06* (2013.01); *F24F 1/46* (2013.01); *F24F 1/48* (2013.01); *F25D 17/06* (2013.01)

(58) Field of Classification Search
CPC ..... F25D 17/06; F24F 1/48; F24F 1/06; F24F 1/46; F24F 1/24
USPC ..... 62/259.2, 180, 419, 259.1, 426, 498
See application file for complete search history.

(56) References Cited

U.S. PATENT DOCUMENTS

| | | | | |
|---|---|---|---|---|
| 3,411,311 | A * | 11/1968 | Wegman | F24F 11/30 62/180 |
| 3,623,335 | A * | 11/1971 | Shanner | F24F 11/085 62/140 |
| 5,775,119 | A * | 7/1998 | Yamada | F24F 1/06 312/100 |
| 2005/0172656 | A1* | 8/2005 | Jung | F24F 1/26 62/324.1 |
| 2006/0130516 | A1* | 6/2006 | Sugiyama | F24F 1/46 62/507 |
| 2007/0006610 | A1* | 1/2007 | Kawasaki | F24F 1/22 62/507 |
| 2009/0122499 | A1* | 5/2009 | Takeichi | F24F 1/22 361/796 |

(Continued)

FOREIGN PATENT DOCUMENTS

| | | |
|---|---|---|
| CN | 1952512 | 4/2007 |
| EP | 1 416 230 | 5/2004 |

(Continued)

OTHER PUBLICATIONS

European Search Report dated Dec. 23, 2015.
Chinese Office Action (with English translation) dated Jul. 4, 2018 issued in CN Application No. 201410785411.6.

*Primary Examiner* — Emmanuel E Duke
(74) *Attorney, Agent, or Firm* — KED & Associates, LLP

(57) ABSTRACT

In an outdoor unit of an air conditioner, a control box of the outdoor unit of the air conditioner is configured so that heat exchange chamber-side air flows toward a fan motor assembly via an inside of the control box by operation of the fan motor assembly. Thus, the inside of the control box may be efficiently cooled.

11 Claims, 6 Drawing Sheets

(56) References Cited

U.S. PATENT DOCUMENTS

| | | | | |
|---|---|---|---|---|
| 2010/0218919 | A1* | 9/2010 | Shibata | F24F 12/006 165/104.34 |
| 2010/0226104 | A1* | 9/2010 | Takeichi | F24F 1/22 361/752 |
| 2010/0294466 | A1* | 11/2010 | Shimaoka | F24F 1/24 165/104.33 |
| 2012/0194041 | A1* | 8/2012 | Hika | F24F 1/22 312/100 |
| 2012/0195000 | A1* | 8/2012 | Hika | F24F 1/24 361/692 |
| 2013/0255932 | A1* | 10/2013 | Doepker | F28D 15/00 165/287 |

FOREIGN PATENT DOCUMENTS

| | | | | |
|---|---|---|---|---|
| EP | 1416230 | A1 * | 5/2004 | F24F 1/24 |
| EP | 1 684 022 | | 7/2006 | |
| EP | 2 241 830 | | 10/2010 | |
| JP | 11-51423 | | 2/1999 | |
| JP | 11-118200 | | 4/1999 | |
| JP | 2010-054168 | | 3/2010 | |
| JP | 4670365 | | 4/2011 | |
| JP | 4748144 | | 8/2011 | |
| JP | 2012-137229 | | 7/2012 | |
| KR | 10-2007-0022948 | A | 2/2007 | |
| KR | 10-2007-0077917 | A | 7/2007 | |

* cited by examiner

OUTDOOR UNIT FOR AIR CONDITIONER

CROSS-REFERENCE TO RELATED APPLICATION(S)

The present application claims priority under 35 U.S.C. 119 and 35 U.S.C. 365 to Korean Patent Application No. 10-2014-0004314 filed Jan. 14, 2014 in Korea, which is hereby incorporated by reference in its entirety.

BACKGROUND

1. Field

An outdoor unit for an air conditioner is disclosed herein.

2. Background

In general, air conditioners are cooling/heating systems in which indoor air is suctioned in to heat-exchange the suctioned air with a low or high-temperature refrigerant, and then, the heat-exchanged air is discharged into an indoor space to cool or heat the indoor space, and the above-described processes are repeatedly performed. Air conditioners may generate a series of cycles and include a compressor, an outdoor heat exchanger, an expansion valve, and an evaporator.

Such an air conditioner may include an outdoor unit or device (referred to as an "outdoor-side" or "heat dissipation-side"), which is mainly installed in an outdoor space, and an indoor unit or device (referred to as an "indoor-side" or "heat absorption-side"), which is mainly installed in a building. The outdoor unit may include a heat exchanger, that is, an outdoor heat exchanger, and a compressor, and the indoor unit may include a heat exchanger, that is, an indoor heat exchanger, and an evaporator.

As is well known, air conditioners may be classified into spilt type air conditioners having outdoor and indoor units or devices separately installed with respect to each other, and integrated type air conditioners having outdoor and indoor units or devices integrally installed with respect to each other. When considering an installation space or noise, the spilt type air conditioners may be generally preferred.

In such a spilt type air conditioner, an outdoor unit or device is separated from an indoor unit or device and disposed in an outdoor space, and a refrigerant collected from the indoor unit is compressed and then heat-exchanged in an outdoor heat exchanger to supply a high-pressure liquid refrigerant. For this, the outdoor unit may include a compressor, the outdoor heat exchanger, a blower fan, and a control box that controls operations of the above-described components and supplies power to electronic components.

The control box may include the plurality of electronic components which generate heat when the electronic components operate. In particular, high-temperature heat may be generated from a power supply device. Thus, components mounted on a substrate may abnormally operate due to the heat generated by the control box. If a large amount of heat is generated by the control box, the components mounted on the substrate may be damaged.

To solve this, Korean Patent Publication No. 10-2007-0022948 discloses a structure in which a heatsink to cool a printed circuit board (PCB) is disposed on or at one side of a control box. A cooling guide to define a passage that guides air flowing by a fan motor assembly toward the heatsink is disposed on or at one side of the control box to improve a heat dissipation effect due to the heatsink.

Also, Korean Patent Publication No. 10-2007-0077917 discloses a structure in which an air suction hole through which external air is introduced, a convection guide plate to guide a flow direction of the air, and a heat dissipation fan to forcibly blow the air within the control box to the outside are provided in the control box of an outdoor unit or device to allow the air within the control box to forcibly flow, thereby cooling the inside of the control box.

BRIEF DESCRIPTION OF THE DRAWINGS

Embodiments will be described in detail with reference to the following drawings in which like reference numerals refer to like elements, and wherein.

DETAILED DESCRIPTION

Figure 1:
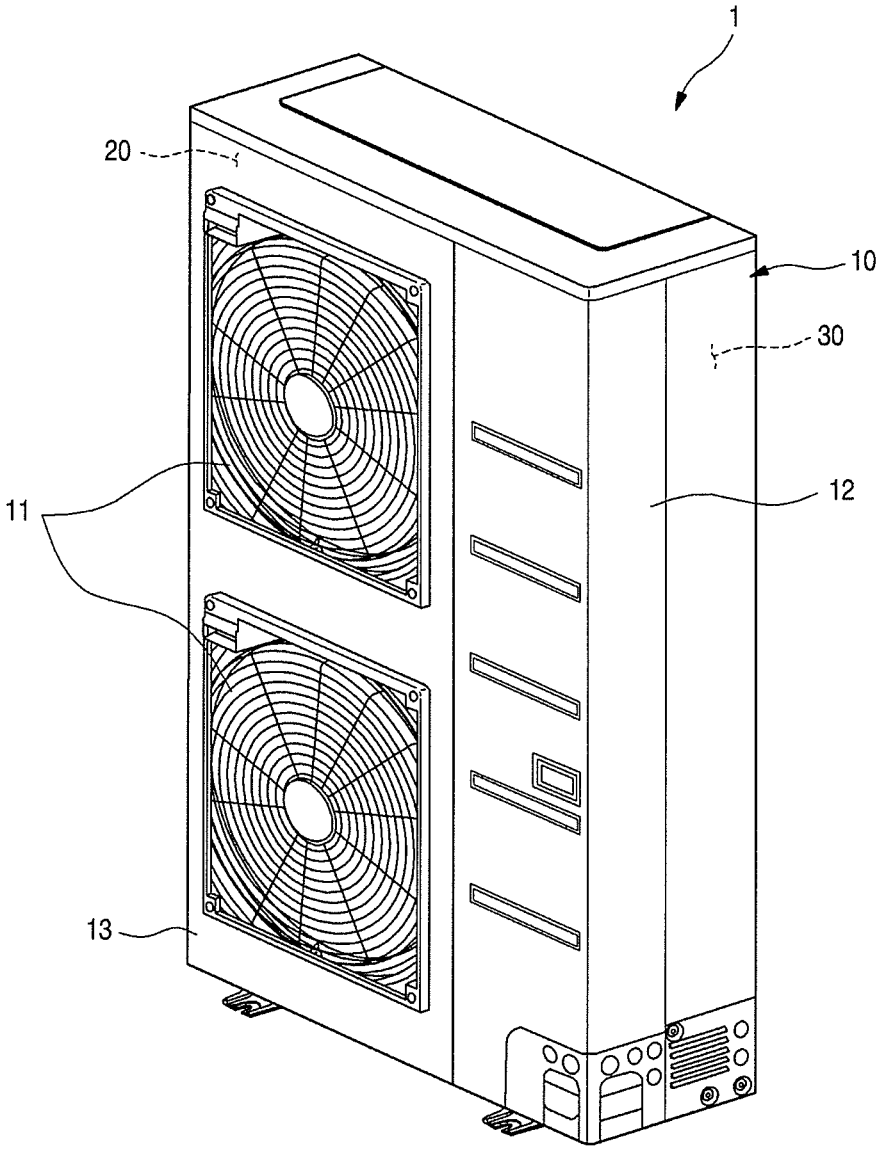
FIG. 1 is a perspective view of an outdoor unit or device of an air conditioner according to an embodiment.

Reference will now be made in detail to embodiments, examples of which are illustrated in the accompanying drawings. The technical scope of the embodiments will fall within the scope of this disclosure, and addition, deletion, and modification of components or parts are possible within the scope of the embodiments. Where possible, like reference numerals have been used to indicate like elements, and repetitive disclosure has been omitted.

Figure 2:
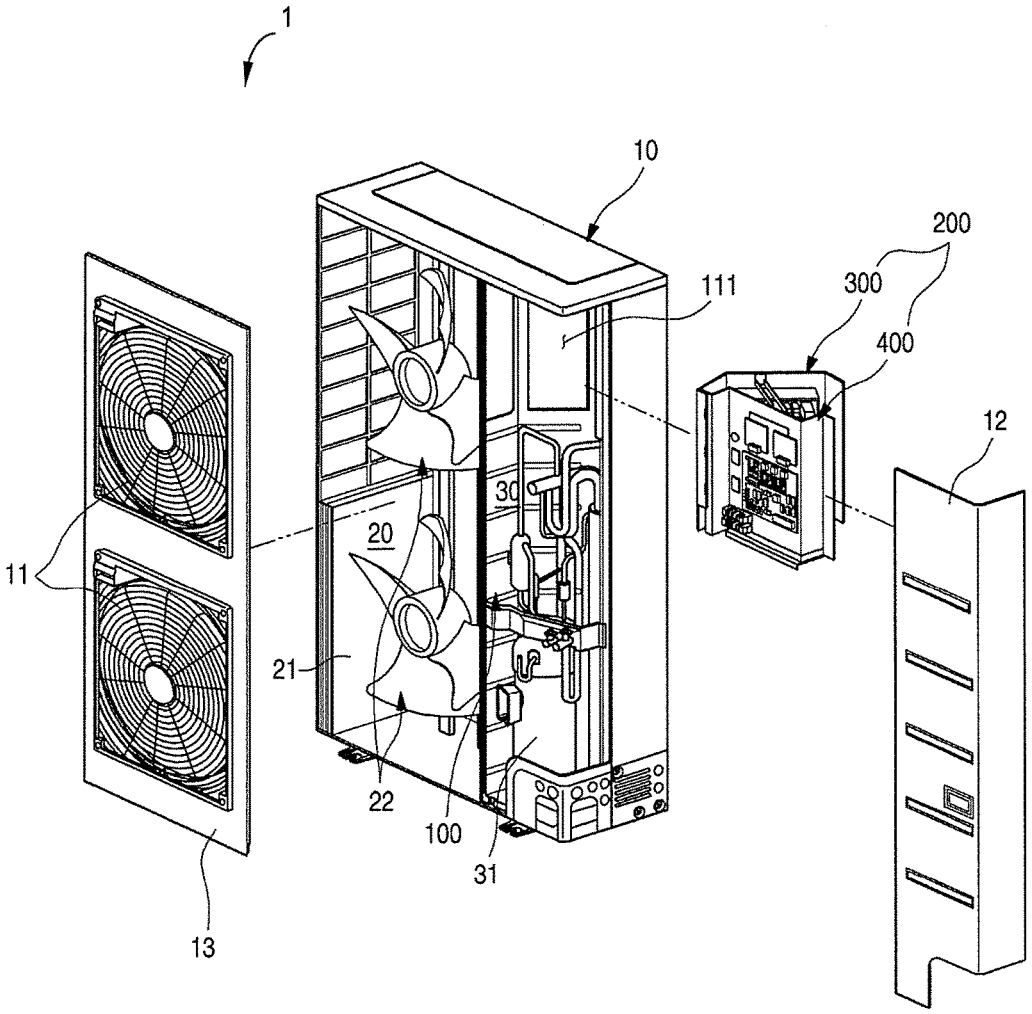
FIG. 2 is an exploded perspective view of the outdoor unit of FIG. 1.

FIG. 1 is a perspective view of an outdoor unit or device of an air conditioner according to an embodiment. FIG. 2 is an exploded perspective view of the outdoor unit of FIG. 1.

Referring to FIGS. 1 and 2, an outdoor unit or device 1 of an air conditioner (hereinafter, referred to as an "outdoor unit") according to an embodiment may be connected to an indoor unit or device through a refrigerant tube to supply or collect a refrigerant. The outdoor unit 1 may be installed in a state standing upright in an outdoor space.

An overall exterior of the outdoor unit may be defined by an outer case 10. An inside of the outer case 10 may be partitioned by a barrier 100. Spaces partitioned by the barrier 100 may be defined as a heat exchange chamber 20, in which an outdoor heat exchanger 21 may be disposed, and a machine room 30, in which a compressor 31, a refrigerant tube, and a control box 200 may be disposed.

One or more grill part or grill 11, through which the outdoor heat exchanger 21 may be heat-exchanged with outdoor air, may be disposed on each of front and rear surfaces of the outer case 10 corresponding to the heat exchange chamber 20. One or more fan motor assembly including a blower fan 22 and a fan motor may be disposed inside the heat exchange chamber 20 corresponding to the grill part 11. Thus, the outdoor air may pass through the outdoor heat exchanger 21 by rotation of the blower fan 22. Thus, the refrigerant within the outdoor heat exchanger 21 may be heat-exchanged with the outdoor air.

At least a portion of the outer case 10 corresponding to the machine room 30 may be open. The open portion of the machine room 30 may be covered by a panel 12. Thus, when the panel 12 is open, an inside of the machine room 30, that is, the control box 200 within the machine room 30 may be serviced.

The compressor 31 may be disposed on a bottom inside of the machine room 30, which may be partitioned by the barrier 100. The compressor 31 may be connected to the outdoor heat exchanger 21 and the indoor unit through the refrigerant tube, and a refrigerant tube that connects the outdoor heat exchanger 21 to the indoor unit may also be disposed inside of the machine room 30. Thus, the pair of refrigerant tubes connected to the indoor unit may be accessible through the outer case 10. Also, although not shown, various valves, such as an electronic expansion valve and a switching valve, a dryer, and an accumulator may be disposed in the refrigerant tube within the machine room 30.

The control box 200 may be disposed in an upper portion of the machine room 30. The control box 200 may control an operation of the outdoor unit 1.

Figure 3:
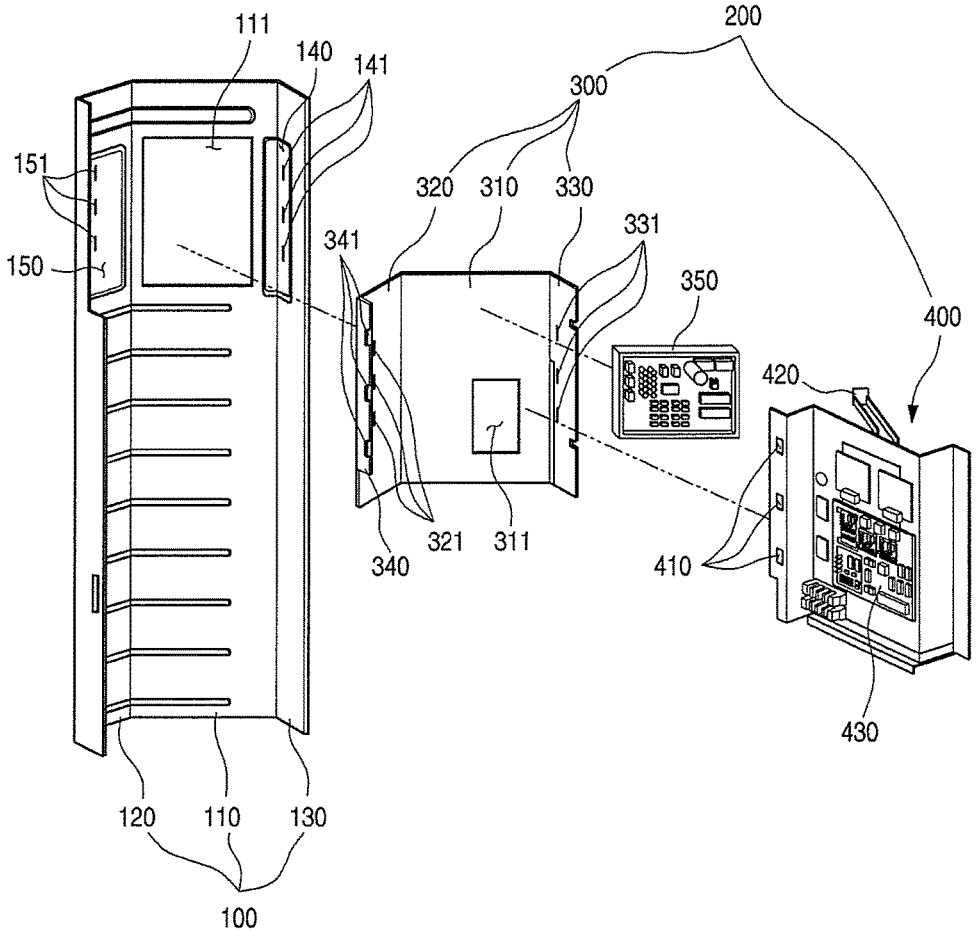
FIG. 3 is an exploded perspective view of a coupling structure between a control box and a barrier according to embodiments.
Figure 4:
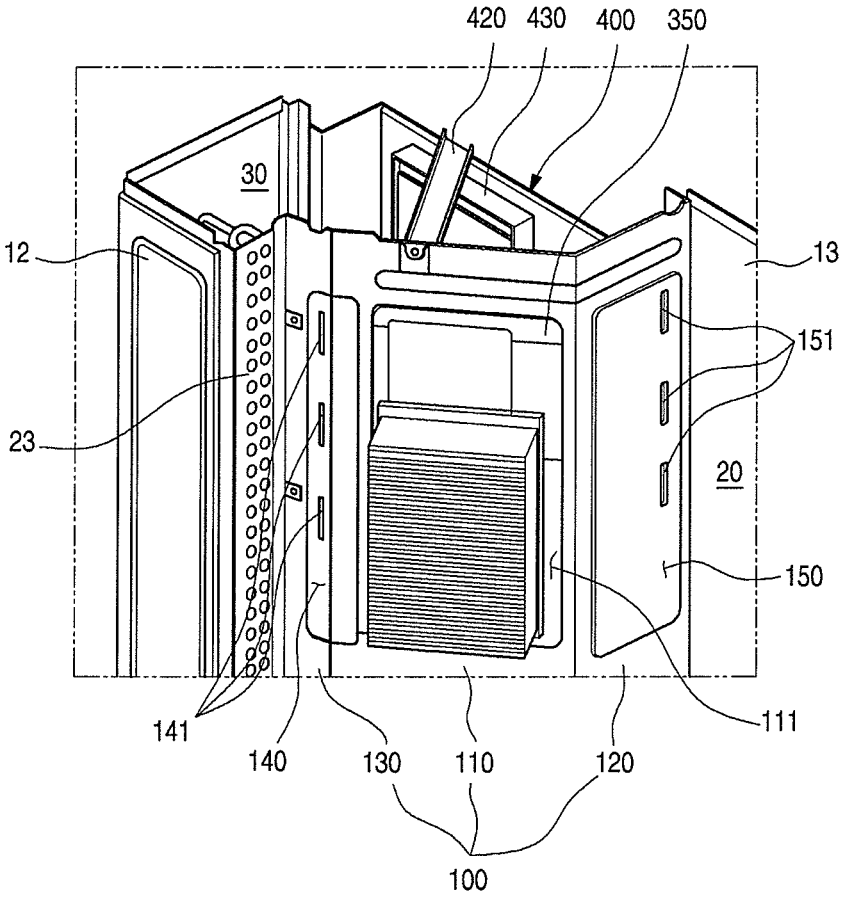
FIG. 4 is a partial perspective view of an inside of a heat exchanger in a state in which the barrier is mounted according to embodiments.
Figure 5:
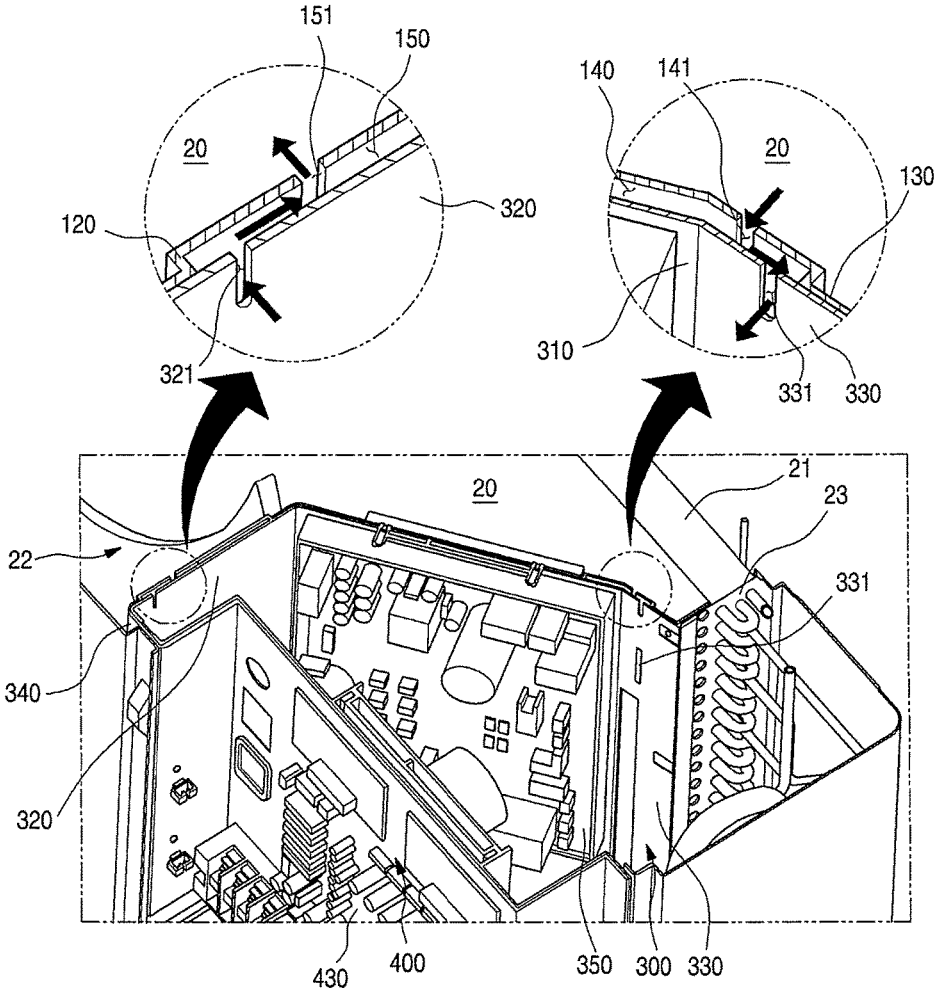
FIG. 5 is a partial cutaway perspective view of a coupling structure of the control box according to embodiments.

FIG. 3 is an exploded perspective view of a coupling structure between a control box and a barrier according to embodiments. FIG. 4 is a partial perspective view of an inside of a heat exchanger in a state in which the barrier is mounted according to embodiments. FIG. 5 is a partial cutaway perspective view of a coupling structure of the control box according to embodiments.

The barrier 100 will now be described in more detail with reference to FIGS. 3 to 5. The barrier 100 may have a plate shape to partition the heat exchange chamber 20 and the machine room 30 into left and right or first and second sides.

The barrier 100 may include a left or first part or portion 120, a right or second part or portion 130, and a central part or portion 110 disposed between the left part 120 and the right part 130. Each of the left part 120 and the right part 130 may be bent from an end of the central part 110 with respect to the central part 110. Also, the central part 110 may be inclined with respect to the left part 120 and the right part 130.

An end of the left part 120 may be fixed to a front panel 13 that defines a front surface of the outer case 10. To easily fix the left part 120 to the front panel 13, the left part 120 may be bent to surface-contact the front panel 13. Also, an end of the right part 130 may be fixed to an outdoor heat exchanger bracket 23 to fix the outdoor heat exchanger 21. The right part 130 and the outdoor heat exchanger bracket 23 may be integrated with each other.

As occasion demands, if the partitioned structure between the heat exchange chamber 20 and the machine room 30 is maintained, the left part 120 and the right part 130 may be fixed by a separate bracket. The barrier 100 may further have an upper portion that partitions a space between the heat exchange chamber 20 and the machine room 30, and in which an opening 111 may be defined. The opening 111 may be defined in the central part 110 and have a size less than a size of a base plate 300 of the control box 200, which will be described hereinbelow.

The opening 111 may be covered by one surface of the base plate 300. A heatsink 351 may be disposed on the base plate 300, which may be exposed through the opening 111. Thus, the heatsink 351 may be exposed to the inside of the heat exchange chamber 20, and the control box 200 may be indirectly cooled by air flowing into the heat exchange chamber 20.

An inflow passage and a discharge passage that communicate with the heat exchange chamber 20 may be defined between the barrier 100 and the control box 200. That is, when the control box 200 is mounted on the barrier 100, the inflow passage and the discharge passage may be formed. Thus, air may be discharged into the heat exchange chamber 20 via the inside of the control box 200 through the inflow passage and the discharge passage.

The inflow passage may be defined as one or more barrier inflow hole 141, a barrier inflow part or barrier inflow 140, and one or more base inflow hole 331, and the discharge passage may be defined as one or more base discharge hole 321, a barrier discharge part or barrier discharge 150, and one or more barrier discharge hole 151.

In detail, the barrier inflow part 140 and the barrier discharge part 150, which may be recessed when viewed from a side of the machine room 30, may be provided in both left/right or first/second sides of the opening 111. The barrier inflow part 140 may be defined from the right part 130 to the central part 110. Also, the barrier inflow part 140 may be defined lengthwise in a vertical direction. The barrier inflow part 140 may have a length corresponding to or less than a vertical length of the base plate 300 that defines a rearmost surface of the control box 200. The barrier inflow part 140 may be defined lengthwise in the vertical direction to define the inflow passage through the coupling of the base plate 300.

The barrier inflow hole 141, through which the air within the heat exchange chamber 20 may be introduced, may be defined in the barrier inflow part 140. The barrier inflow hole 141 may be defined lengthwise in a vertical direction. A plurality of the barrier inflow holes 141 may be provided. The plurality of barrier inflow holes 141 may be vertically arranged. Also, the barrier inflow hole(s) 141 may be defined at a position biased in one direction in an inner area of the barrier inflow part 140, and thus, may be disposed at a position adjacent to an end of the indoor heat exchanger 21. The barrier inflow hole(s) 141 may be defined at a portion of the barrier 100 which may be positioned away from the blower fan 22 in a horizontal direction. A flow rate of air may be relatively low at a side of the outdoor heat exchanger 21 corresponding to the barrier inflow hole(s) 141 due to a distance from the blower fan 22.

The barrier discharge part 150 may be recessed from the left part 120 to the central part 110. Also, the barrier discharge part 150 may be defined lengthwise with a length corresponding to a length of the barrier inflow part 140. Also, the discharge passage may contact the base plate 300.

The barrier discharge hole 151, through which the air within the machine room 30 may be discharged into the heat exchange chamber 20, may be defined in the barrier discharge part 150. The barrier discharge hole 151 may be lengthily defined in a vertical direction. A plurality of the barrier discharge holes 151 may be provided. The plurality of barrier discharge holes 151 may be vertically arranged. Also, the barrier discharge hole(s) 151 may be defined at a position that is biased in one direction in an inner area of the barrier discharge part 150, and thus, may be disposed at a position adjacent to the blower fan 22.

Each of the barrier discharge part 150 and the barrier discharge hole(s) 151 may be disposed at a same height as a height of each of the barrier inflow part 140 and the barrier inflow hole(s) 141. Thus, the air introduced into the barrier inflow hole(s) 141 may pass through the inside of the control box 200 along a shortest path, and then may be discharged through the barrier discharge hole(s) 151.

The control box 200 may include the base plate 300 fixed to the barrier 100 to define a bottom or rear surface thereof, a first PCB 350 mounted on the base plate 300, a cover plate 400 disposed above or in front of the base plate 300, and a second PCB 430 mounted on the cover plate 400. The base plate 300 may be bent in a shape corresponding to the bent left, right, and central parts 120, 130, and 110 of the barrier 100 so that the base plate 300 may be closely attached to the barrier 100. The base plate 300 may have a size that is capable of covering both the barrier inflow part 140 and the barrier discharge part 150.

The base plate 300 may have a central surface 310 corresponding to the central part 110 of the barrier 100 and left and right or first and second surfaces 320 and 330 corresponding to the left and right parts 120 and 130 of the barrier 100. Thus, the base plate 300 may be closely attached to a side surface the barrier 100 in the machine room 30. An end of the right surface 330 together with an end of the right part 130 may be fixed to the outdoor heat exchanger bracket 23. The left surface 320 may be closely attached and bonded to the left part 120.

A fixing end 340 may be disposed on or at an end of the left surface 320. The fixing end 340 may be bent from the end of the left surface 320 toward the inside of the machine room 30 to extend in a direction substantially parallel to the front panel 13.

A fixing part or portion 341 to fix the cover plate 400 may be disposed on the fixing end 340. The fixing part 341 may be coupled to a restriction part or portion 410 disposed on the cover plate 400 to maintain a state in which the cover plate 400 is mounted on the fixing end 340.

A support bracket 420 may be disposed between the base plate 300 and the cover plate 400. The base plate 300 and the cover plate 400 may be fixed to each other while being spaced apart from each other by the support bracket 420.

The first PCB 350 may be mounted on the central surface 310 of the base plate 300. A heatsink hole 311, in which the heatsink 351 may be disposed, may be opened and defined in the central surface 310 corresponding to a position at which the first PCB 350 is mounted. The heatsink 351, mounted on or at a heat generation position of the first PCB 350, may be exposed to the inside of the heat exchange chamber 20 through the heatsink hole 311 and the opening 111. Thus, the first PCB 350 may emit heat by the air flowing into the heat exchange chamber 20, and thus, may be indirectly cooled.

Components having relatively high heat generation may be mounted on the first PCB 350 when compared to the second PCB 430. For example, a power supply device that supplies power to the outdoor unit 1, an intelligent power module (IPM) to control the compressor 31 in an inverter manner, and a switching device or switch, such as an insulated-gate bipolar transistor (IGBT) bridge diode, may be mounted on the first PCB 350.

Of course, components having heat generation greater than a heat generation of components mounted on the second PCB 430 and having a demand for cooling in addition to the above-described components may be mounted on the first PCB 350. The first PCB 350 may include a plurality of PCBs. Alternatively, the first PCB 350 may be formed by combining electronic components that are separately provided with respect to the plurality of PCBs.

The base inflow hole(s) 331 and the base discharge hole(s) 321 may be defined in the left surface 320 and the right surface 330 of the base plate 300, respectively. The base inflow hole(s) 331 may define a passage, through which the air within the heat exchange chamber 20, which may be introduced through the barrier inflow hole(s) 141, may be introduced into the control box 200.

The base inflow hole(s) 331 may be open and defined in the left surface 320 of the base plate 300 and be defined lengthwise in the vertical direction. A plurality of the base inflow holes 331 may be provided, and the plurality of base inflow holes 331 may be vertically arranged. Also, the base inflow hole(s) 331 may be horizontally spaced apart from the barrier inflow hole(s) 141 without overlapping the barrier inflow hole(s) 141. Thus, foreign substances in introduced air may be prevented from being directly introduced into the control box 200 and damaging the components within the control box 200, and also, a flow rate of the air may be adjusted.

The base discharge hole(s) 321 may be open and defined in the right surface 330 of the base plate 300 and be defined lengthwise in the vertical direction. A plurality of the base discharge holes 321 may also be provided, and the plurality of base discharge holes 321 may be vertically arranged. Also, the base discharge hole(s) 321 may be horizontally spaced apart from the barrier discharge hole(s) 151 without overlapping the barrier discharge hole(s) 151.

The base inflow hole(s) 331 and the base discharge hole(s) 321 may be defined in the left surface 320 and the right surface 330, respectively. Also, the base inflow hole(s) 331 and the base discharge hole(s) 321 may be inclined with respect to the central surface 310. That is, the base inflow hole(s) 331 and the base discharge hole(s) 321 may be open in directions that cross each other. The first PCB 350 may be inclined between the base inflow hole(s) 331 and the base discharge hole(s) 321. Thus, the air introduced through the base inflow hole(s) 331 may flow to entirely pass through the first PCB 350, and then, may be discharged through the base discharge hole(s) 321.

Hereinafter, an operation for cooling the control box of the outdoor unit of the air conditioner including the above-described components according to an embodiment will be described.

Figure 6:
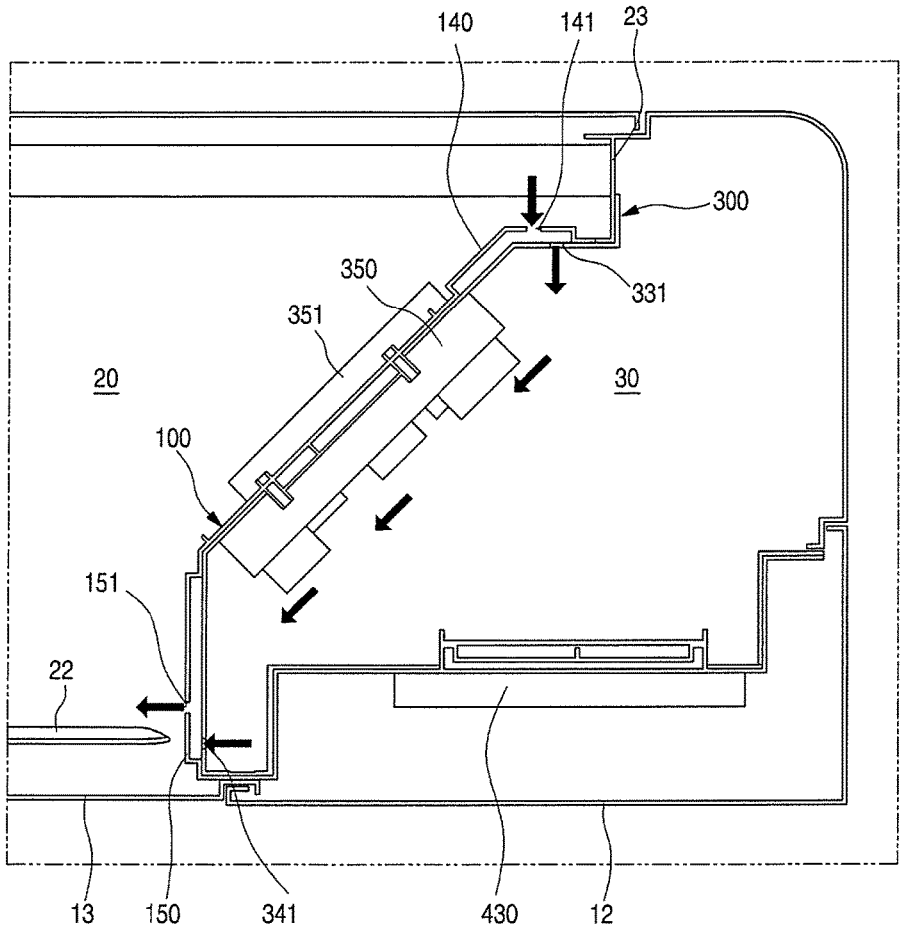
FIG. 6 is a cross-sectional view of an air flow path of the control box according to embodiments.

FIG. 6 is a cross-sectional view of an air flow path of the control box according to embodiments.

Referring to FIG. 6, the outdoor unit 1 may operate according to an input of an operation signal. The compressor 31, the various valves, and a fan motor assembly including the blower fan 22, which form the outdoor unit 1, may operate by the control of the first and second PCBs 350 and 430.

The blower fan 22 may rotate according to operation of the outdoor unit 1. External air may pass through the outdoor heat exchanger 21, and then, may be discharged to the grill part(s) 11 disposed on the front panel 13 via the blower fan 22. Due to the air flow as described above, refrigerant within the outdoor heat exchanger 21 may be heat-exchanged to circulate into a refrigeration cycle.

When the outdoor unit 1 operates, the inside of the control box 200, more particularly, the first PCB 350 may increase in temperature. However, the first PCB 350 may emit heat to the heatsink 351 exposed to the heat exchange chamber 20, and thus, may be primarily cooled.

Also, as the blower fan 22 operates, a pressure difference due to a flow rate of the air may occur between a discharge passage-side, which may be adjacent to the blower fan 22, and an inflow passage-side, which may be far away from the blower fan 22. That is, the discharge passage-side may be disposed at a position which is adjacent to the blower fan 22, and thus, may have a relatively low pressure generated by the high flow rate due to rotation of the blower fan 22. Also, as the inflow passage-side communicates with one side of the heat exchange chamber 20 which is far away from the blower fan 22, a relatively low flow rate may be generated at the inflow passage-side. Thus, the inflow passage-side may naturally have a relatively high pressure. As a result, the air may be introduced through the inflow passage to flow toward the discharge passage.

In detail, due the pressure difference according to the operation of the blower fan 22, the air within the heat exchange chamber 20 may be introduced into the control box 200. The air within the heat exchange chamber 20 may be introduced through the barrier inflow hole(s) 141 to detour at the barrier inflow part 140, and then, may be introduced into the control box 200 through the base inflow hole(s) 331.

The air introduced into the control box 200 may flow toward the discharge passage. In this case, the air may pass through the first PCB 350 disposed on the inclined central surface 310. Thus, the first PCB 350 may be naturally further cooled by the air passing through the first PCB 350. In addition, the components including the first PCB 350 and disposed on the central surface 310 may be cooled.

The air within the control box 200, which may be introduced through the base inflow hole(s) 331, may detour through the base discharge hole(s) 321, and then, may be discharged toward a rotational center of the blower fan 22 through the barrier discharge hole(s) 151.

The air passing through the inflow passage and the discharge passage may pass through the barrier inflow part 140 and the barrier discharge part 150 to detour. Thus, introduction of foreign substances may be prevented, and also an adequate flow rate may be secured to sufficiently cool the first PCB 350 within the control box 200 and reduce flow noise.

Also, as the inflow passage and the discharge passage may be disposed at a same height, the air passing through the control box 200 may flow along the shortest path to secure a sufficient flow rate to cool the first PCB 350.

According to the outdoor unit including the above-described components, the inflow passage and the discharge passage, which may pass through the barrier and the control box, may be defined, and the PCB may be disposed between the inflow passage and the discharge passage to allow the air to flow, thereby naturally cooling the PCB. Also, the inflow passage may be open toward the heat exchanger of the heat exchange chamber, and the discharge passage may be open toward the blower fan to allow the air to smoothly flow without using a separate power due to a pressure difference by a flow rate generated by operation of the blower fan to cool the inside of the control box.

The control box may be provided with two stages of the base plate and the cover plate and include the first and second PCBs, which may be respectively mounted on the base plate and the cover plate to reduce an installation space. In addition, the first PCB having the relatively high heat generation may be mounted on the base plate to intensively cool the first PCB by the air flowing through the inflow passage and the discharge passage.

The inflow passage and the discharge passage may be formed by coupling the barrier and the control box. The pair of openings, through which the air may be accessible, may be disposed cornerwise with respect to each other to prevent foreign substances from being introduced and prevent the occurrence of noise through adjustment of the flow rate.

Embodiments disclosed herein provide an outdoor unit or device of an air conditioner, in which a fan motor assembly operates to allow heat exchange chamber-side air to flow toward the fan motor assembly via the inside of a control box, thereby efficiently cooling the inside of the control box.

Embodiments disclosed herein provide an outdoor unit or device of an air conditioner that may include a barrier that partitions an inside of the outdoor unit into a heat exchange chamber and a machine room; a blower fan disposed in the heat exchange chamber to allow heat exchange chamber-side air to forcibly flow; an outdoor heat exchanger disposed in the heat exchange chamber, the outdoor heat exchanger being heat-exchanged with the air flowing by the blower fan; a control box disposed on the machine room-side barrier to control an operation of the outdoor unit; and inflow and discharge passages defined by coupling the barrier to the control box to provide an air flow path by the heat exchange chamber and control box which communicate with each other. The discharge passage may be disposed at a position that is more adjacent or closer to the blower fan than the inflow passage.

A printed circuit board (PCB) may be disposed inside of the control box, and the PCB may be disposed in a direction that crosses a direction, in which the inflow passage and the discharge passage are opened, between the inflow passage and the discharge passage. The inflow passage may be opened to the outdoor heat exchanger, and the discharge passage may be opened to the blower fan. The discharge passage may be opened in a lateral direction of the blower fan.

The control box may be disposed between the inflow passage and the discharge passage. An opening may be defined in the barrier and covered by the control box. A heatsink may be attached to the PCB, and the heatsink may pass through the barrier and be exposed to the inside of the heat exchange chamber.

The control box may include a central part or portion, on which the PCB may be mounted; and left and right or first and second parts or portions bent from both left/right or first/second ends of the central part. The inflow passage and the discharge passage may be defined in the right part and the left part, respectively.

The control box may include a base plate coupled to the barrier to define the inflow passage and the discharge passage, and a cover plate spaced apart from the base plate. The PCB may include a first PCB mounted on the base plate and having relatively high heat generation, and a second PCB mounted on the cover plate and having relatively low heat generation.

At least a portion of each of the inflow passage, the discharge passage, and the PCB may be disposed at a same height. The inflow passage and the discharge passage may be opened to the inside of the control box in directions crossing each other.

The inflow passage may be defined as a barrier inflow part or inflow recessed from the barrier and inflow holes, respectively, opened and defined in the barrier inflow part and the control box, and the discharge passage may be defined as a barrier discharge part or discharge recessed from the barrier and discharge holes, respectively, opened and defined in the barrier discharge part and the control box. The inflow hole and the discharge hole defined in the barrier may be horizontally spaced apart from the inflow hole and the discharge hole defined in the control box.

Each of the inflow holes and the discharge holes may extend lengthwise in a vertical direction. The inflow holes and the discharge holes may be continuously arranged in the vertical direction.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device of an air conditioner, the outdoor device comprising:

a barrier that partitions an inside of the outdoor device into a heat exchange chamber and a machine room, the barrier including a first wall, a second wall, and a central wall disposed between the first wall and the second wall, wherein adjacent sections of the central wall and the second wall are recessed toward the heat exchange chamber, and a section of the first wall is recessed toward the heat exchange chamber;

one or more blower fan disposed in the heat exchange chamber to allow heat exchange chamber-side air to forcibly flow;

an outdoor heat exchanger disposed in the heat exchange chamber, wherein the outdoor heat exchanger performs heat-exchange with air flowing due to the blower fan;

a control box disposed in the machine room to control an operation of the outdoor device; and a base plate installed at a surface of the barrier facing the machine room, wherein the first wall of the barrier extends to bend from one side end of the central wall, and the second wall of the barrier extends to bend from the other side end of the center wall;

wherein the barrier further includes:

a barrier discharge formed to be recessed in the first wall of the barrier, the barrier discharge forming a barrier discharge hole that guides air to be discharged from the heat exchange chamber; and a barrier inflow formed to be recessed in the second wall of the barrier, the barrier inflow forming a barrier inflow hole that guides air into the heat exchange chamber, wherein the base plate includes:

a central surface coupled at the central wall of the barrier;

a left surface extending from one end of the central surface to face the first wall of the barrier and be spaced apart from the first wall; and a right surface extending from another end of the central surface to face the second wall of the barrier and be spaced apart from the second wall, wherein:

the control box is coupled to the central surface of the base plate, air introduced by the barrier inflow hole flows into the machine room through a base inflow hole formed on the right surface of the base plate, and air flowing into the machine room flows into the barrier discharge hole through a base discharge hole formed on the left surface of the base plate and positioned closer to the blower fan than the right surface.

2. The outdoor device according to claim 1, wherein the barrier inflow hole is open to the outdoor heat exchanger, and wherein the barrier discharge hole is open to the blower fan.

3. The outdoor device according to claim 1, wherein the barrier discharge hole is open in a lateral direction of the blower fan.

4. The outdoor device according to claim 1, further comprising:

inflow passages defined by between the barrier inflow hole and the base inflow hole; and discharge passages defined between the base discharge hole and the barrier discharge hole, wherein the inflow passages and the discharge passages communicate with each other.

5. The outdoor device according to claim 4, wherein the inflow passages and the discharge passages are in flow communication with each other so that imaginary lines drawn along respective paths of air flowing into the respective passages cross each other.

6. The outdoor device according to claim 1, wherein an opening is defined in the central wall of the barrier, and wherein the opening is covered by the control box.

7. The outdoor device according to claim 6, further comprising: a heatsink installed at one surface of the central wall to face the heat exchange room, wherein the heatsink is attached to a printed circuit hoard (PCB), and wherein the heatsink passes through the barrier via the opening and is exposed to an inside of the heat exchange chamber.

8. The outdoor device according to claim 1, wherein the control box includes: a first printed circuit board (PCB) mounted on the base plate; and a second printed circuit hoard (PCB) mounted on a cover plate installed at an end of the left surface, wherein the second PCB has a lower heat generation than the first PCB.

9. The outdoor device according to claim 8, wherein at least portions of the barrier inflow hole, the base inflow hole, the base discharge hole, the barrier discharge hole, and the control box are disposed at a same height.

10. The outdoor device according to claim 1, wherein the barrier inflow hole and the barrier discharge hole defined in the barrier are horizontally spaced apart from the base inflow hole and the base discharge hole defined in the base plate.

11. The outdoor device according to claim 10, wherein the barrier inflow hole, the base inflow hole, the base discharge hole, and the barrier discharge hole are formed to extend in a vertical direction.

* * * * *